US005337128A

United States Patent [19]

Hashizume et al.

[11] Patent Number: 5,337,128

[45] Date of Patent: Aug. 9, 1994

[54] IMAGE-FORMING MACHINE WITH TONER IMAGE TRANSFER MEANS

[75] Inventors: Masahiro Hashizume; Hiroshi Kimura; Hiroshi Ishida; Masanobu Maeshima; Koichi Yasuda; Shigeki Hayashi; Hiroshi Kubota; Osamu Yoshimura; Susumu Taniguchi, all of Osaka; Yasuo Hatate, Kagoshima, all of Japan

[73] Assignee: Mita Industrial Co., Ltd., Osaka, Japan

[21] Appl. No.: 117,948

[22] Filed: Sep. 8, 1993

[30] Foreign Application Priority Data

Oct. 22, 1992 [JP] Japan ..... 4-284120

[51] Int. Cl.[5] ..... G03G 15/14

[52] U.S. Cl. ..... 355/271; 355/273; 355/276

[58] Field of Search ..... 355/271, 273, 274, 276, 355/219; 361/225, 230

[56] References Cited

U.S. PATENT DOCUMENTS

| | | | |
|---|---|---|---|
| 4,908,668 | 3/1990 | Takamatsu et al. | 355/274 |
| 4,929,982 | 5/1990 | Ainoya et al. | 355/274 X |
| 4,943,863 | 7/1990 | Ainoya | 355/271 |
| 4,978,998 | 12/1990 | Aizawa | 355/273 |
| 5,034,777 | 7/1991 | Ohzeki et al. | 355/274 |
| 5,159,391 | 10/1992 | Koshi et al. | 355/271 |
| 5,227,841 | 7/1993 | Takahashi et al. | 355/271 X |
| 5,233,396 | 8/1993 | Simms et al. | 355/274 |
| 5,253,022 | 10/1993 | Takeuchi et al. | 355/274 |

FOREIGN PATENT DOCUMENTS

| | | | |
|---|---|---|---|
| 0200277 | 8/1989 | Japan . | |
| 0284884 | 11/1989 | Japan | 355/274 |

*Primary Examiner*—Matthew S. Smith

*Attorney, Agent, or Firm*—Beveridge, DeGrandi, Weilacher & Young

[57] ABSTRACT

An image-forming machine equipped with a transfer device of the type not using a transfer corona discharger is disclosed. A charge supply member is disposed opposite to an image forming member on whose surface a toner image is to be formed, and at a greater distance than the thickness of a transfer material from the image forming member. A voltage of a predetermined polarity is applied to the charge supply member. In a transfer zone, the surface of the transfer material is brought into contact with the surface of the image forming member, while the back of the transfer material is not contacted with the surface of the charge supply member.

12 Claims, 4 Drawing Sheets

IMAGE-FORMING MACHINE WITH TONER IMAGE TRANSFER MEANS

FIELD OF THE INVENTION

This invention relates to an image-forming machine of the type adapted to form a latent electrostatic image on the surface of an image-forming member such as an electrostatic photosensitive member, develop the latent electrostatic image to a toner image, and then transfer the toner image onto a transfer material such as a paper.

DESCRIPTION OF THE PRIOR ART

As is well known to those skilled in the art, in the above-mentioned type of image-forming machine, the image-forming member such as an electrostatic photosensitive member disposed on the peripheral surface of a rotating drum is conveyed through an endless conveying passage, which comprises a latent electrostatic image forming zone, a developing zone, and a transfer zone in this sequence, according to the rotation of the rotating drum in a predetermined direction. In the latent electrostatic image forming zone, a latent electrostatic image is formed on the surface of the image-forming member by the action of latent electrostatic image forming means. The latent electrostatic image forming means comprises, for example, a uniform charging means for uniformly charging the surface of the image forming member with a predetermined polarity, and an exposure means for exposing the surface of the image forming member to a light in correspondence with an image to be formed, subsequently to the uniform charging means. In the developing zone, a toner is applied by a developing device to the latent electrostatic image that has been formed on the surface of the image forming member, whereby the latent electrostatic image is developed to a toner image. In the transfer zone, the surface of the transfer material is brought into contact with the surface of the image forming member so that the toner image formed on the surface of the image forming member is transferred onto the surface of the transfer material by the action of a transfer means.

A typical example of the transfer means is a transfer corona discharger for applying to the back of the transfer material in the transfer zone a corona discharge of an opposite polarity to the polarity of the latent electrostatic image that has been formed on the surface of the image forming member. The transfer corona discharger, however, poses problems such as the considerable generation of ozone which is undesirable in view of environmental pollution.

Japanese Laid-Open Patent Publication No. 75773/1988, etc. have proposed that the transfer means be constituted not by a charging corona discharger, but by a conductive roller disposed in proximity to the image forming member in the transfer zone (more specifically, with the distance between the image forming member and the conductive roller being made smaller than the thickness of the transfer material). Such a conductive roller is rotationally driven in the direction of conveyance of the transfer material, and a voltage of a reverse polarity to the polarity of the latent electrostatic image that has been formed on the image forming member is applied to the conductive roller. The transfer material is interposed between the image forming member and the conductive roller, and thus is passed through the transfer zone with its surface pressed against the surface of the image forming member. During this passing, the toner image on the surface of the image forming member is transferred onto the surface of the transfer material.

According to experiments and observations by us, the present inventors, the use of the above-described transfer means results in a considerable pressure of contact between the surface of the image forming member and the surface of the transfer material. This tends to cause a partial missing phenomenon in which no toner is present, for example, in part of a character in the transferred image, or an image dust phenomenon in which scattered toner deposits around the characters in the transferred image.

To solve the above problems due to the excessive pressure of contact between the surface of the image forming member and the surface of the transfer material, Japanese Laid-Open Patent Publication No. 200277/1989 discloses that the distance between an image forming member and a charge supply member, such as a conductive roller, is set to be greater than the thickness of a transfer material, and that the back of the transfer material is brought into contact with the charge supply member, such as a conductive roller, in a charge supply zone upstream, as viewed in the direction of conveyance of the transfer material, of the transfer zone where the surface of the transfer material is brought into contact with the surface of the image forming member.

The mechanism disclosed in Japanese Laid-Open Patent Publication No. 200277/1989, however, is still unsatisfactory, because it involves the following problems: First, as the properties, especially stiffness, of the transfer material used change, the position of the charge supply zone where the transfer material contacts the surface of the charge supply member and/or the position of the transfer zone where the transfer material contacts the surface of the image forming member change(s) and in consequence, it is not possible to provide the desired transfer state stably. Second, if the surface of the charge supply member is contaminated owing to the deposition of the toner on the surface of the charge supply member or for any other cause, the back of the transfer material is also contaminated because of its contact with the contaminated surface of the charge supply member.

SUMMARY OF THE INVENTION

A main object of this invention is to provide an image-forming machine which has an improved transfer means of the type using a charge supply member, such as a conductive roller, instead of a transfer corona discharger, and in which even if the surface of the charge supply member is contaminated, the back or surface of a transfer material is not contaminated, and a sufficiently satisfactory transfer of a toner image can be performed stably.

Diligent studies and experiments have led us to the following findings: There is no need to bring the transfer material into contact with the charge supply member, and it suffices to position the charge supply member in proximity to the back of the transfer material whose surface is in contact with the surface of the image forming member in the transfer zone. Because of this positional contrivance, a latent electrostatic image that has been formed on the surface of the image forming member is transferred onto the surface of the transfer material sufficiently satisfactorily. The adoption of this transfer method can solve the various problems with the conventional techniques, and attain the aforementioned technological objective.

The present invention provides an image-forming machine capable of attaining the above object. The image-forming machine comprises an image forming member to be conveyed through a conveying passage which comprises a latent electrostatic image forming zone, a developing zone, and a transfer zone in this sequence, latent electrostatic image forming means for forming a latent electrostatic image on the surface of the image forming member in the latent electrostatic image forming zone, developing means for developing the latent electrostatic image on the surface of the image forming member to a toner image in the developing zone, transfer material conveying means for conveying a transfer material through the transfer zone, and toner image transfer means for transferring the toner image on the surface of the image forming member onto the surface of the transfer material in the transfer zone, the toner image transfer means including a conductive charge supply member disposed opposite to the image forming member, voltage application means for applying a voltage to the charge supply member, and transfer material guide means for guiding the transfer material to be conveyed through the transfer zone, and the surface of the transfer material being brought into contact with the surface of the image forming member in the transfer zone to transfer the toner image on the surface of the image forming member onto the surface of the transfer material; wherein the charge supply member is disposed opposite to the image forming member and at a greater distance than the thickness of the transfer material from the image forming member in the transfer zone, and the transfer material guide means guides the transfer material so as to be conveyed through the transfer zone without being contacted with the charge supply member.

The distance between the charge supply member and the image forming member is preferably 0.2 to 2.0 mm. The image forming member is disposed on the peripheral surface of the rotating drum which is rotationally driven in a predetermined direction about its central axis extending substantially horizontally. The charge supply member is constructed of a roller that is opposite to the peripheral surface of the rotating drum in an angular region which is below the central axis of the rotating drum and in which the peripheral surface of the rotating drum gradually lowers in accordance with the rotation of the rotating drum and that is rotationally driven in the direction of conveyance of the transfer material about its central axis extending substantially parallel to the central axis of the rotating drum. In this case, in order to bring the surface of the transfer material into a fully satisfactory contact with the surface of the image forming member, and to prevent the contact of the transfer material with the charge supply member fully reliably, it is preferred to construct the front end portion of that lower guide means in the transfer material guide means, which defines the underside of a transfer material conveying passage upstream of the transfer zone, in such a manner that it may extend toward the peripheral surface of the rotating drum positioned below a common tangent line contacting the peripheral surface of the rotating drum and then contacting the peripheral surface of the roller as viewed in the rotating direction of the rotating drum. The lower guide means may form the following angle of $\theta$ degrees with respect to the common tangent line: $0° \leqq \theta 90°$, particularly $30° \leqq 60°$. It is preferable that the front end portion of the lower guide means in the transfer material guide means is formed of a flexible plastic film which is made to protrude in a downstream direction. Furthermore, it is preferred that an upper surface which guides the transfer material in a transfer material receiving means disposed downstream of the transfer zone is positioned upward of the above-mentioned common tangent line in a zone within the distance L1 of 50 mm or less ($L1 \leqq 50$ mm) from the position of contact of the common tangent line with the peripheral surface of the rotating drum as viewed in the direction of conveyance of the transfer material.

In the image-forming machine of the present invention, the transfer material is contacted only with the surface of the image-forming member in the transfer zone, so that the transfer material does not make contact with the charge supply member. Therefore, any change in the properties, especially the stiffness, of the transfer material used would result in little change in the state of transfer, thus accomplishing a sufficiently stable, satisfactory transfer. Even if the surface of the charge supply member is contaminated with toner or the like, the back or surface of the transfer material will not get contaminated owing to that.

The reason why a sufficiently stable, satisfactory transfer of the toner image is accomplished even without the contact of the transfer material with the charge supply member may be that a tiny corona discharge is produced by the charge supply member toward the back of the transfer material in the transfer zone. However, such a corona discharge is considerably small (e.g. about 3 $\mu$A) compared with a corona discharge current as used in an ordinary transfer corona discharge device (e.g. 100 to 150 $\mu$A). Thus, the generation of ozone, if any, is negligible.

DETAILED DESCRIPTION OF PREFERRED EMBODIMENTS

Preferred embodiments of an image-forming machine constructed in accordance with the present invention will be described in detail below with reference to the accompanying drawings.

Figure 1:
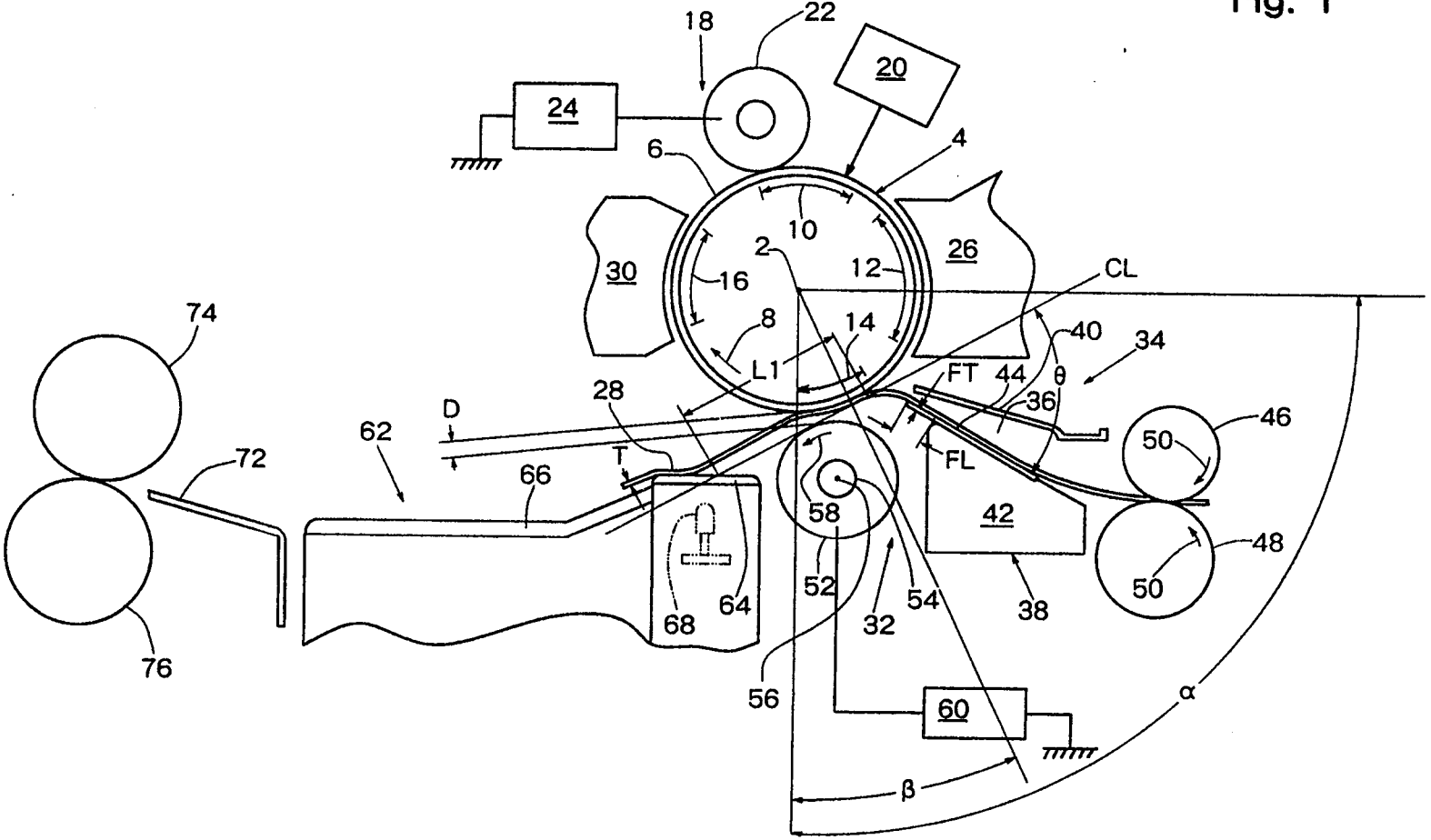
FIG. 1 is a sectional view showing, in a simplified manner, the main constituent elements of an image-forming machine with a transfer means improved in accordance with the present invention.
Figure 2:
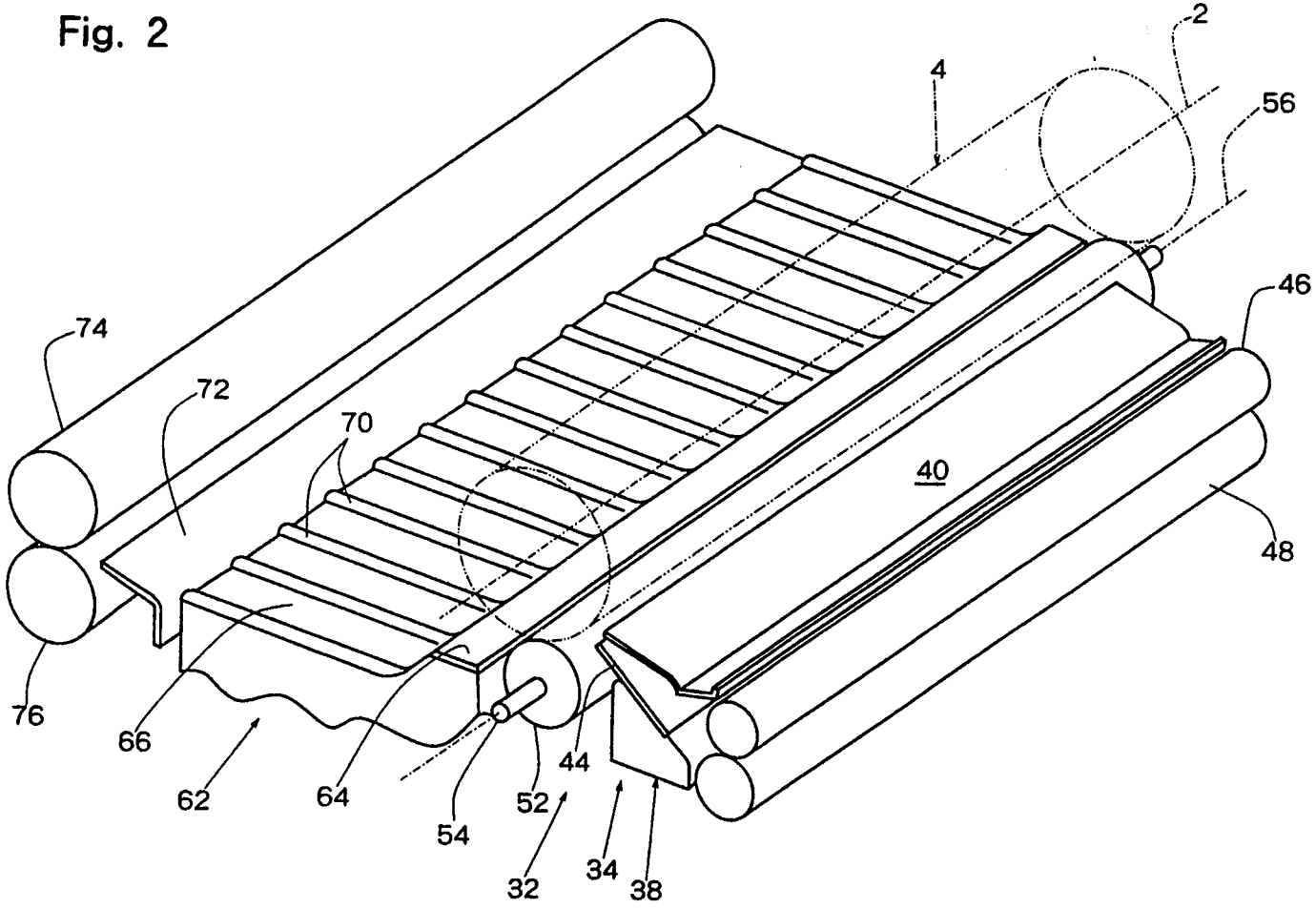
FIG. 2 is a perspective view showing, in a simplified manner, the main constituent elements of the image-forming machine illustrated in FIG. 1.

With reference to FIG. 1, which outlines the main constituent elements of a preferred embodiment of an image-forming machine constructed in accordance with the present invention, the image-forming machine has a rotating drum 4 mounted rotatably about a central axis 2 (see FIG. 2). On the peripheral surface of the rotating drum 4 is disposed an image-forming member 6 which may be a suitable electrostatic photosensitive member. The rotating drum 4 is rotationally driven continuously in a direction shown by an arrow 8, whereby the image-forming member 6 disposed on its surface is conveyed through an endless conveying passage (a circular conveying passage defined by the peripheral surface of the rotating drum 4) which comprises a latent electrostatic image forming zone 10, a developing zone 12, a transfer zone 14 and a cleaning zone 16 in this sequence.

In the latent electrostatic image forming zone 10, a latent electrostatic image is formed on the surface of the image forming member 6 by a latent electrostatic image forming means including a uniform charging means 18 and an exposure means 20. The uniform charging means 18 uniformly charges the surface of the image forming member 6 with a specific polarity (a positive polarity in the drawing). The uniform charging means 18 may be constructed of a so-called contact charging means including a uniform charging roller 22. A desired voltage is applied to the uniform charging roller 22, formed of, for example, a conductive rubber, by a voltage application means 24. Such a contact charging means itself is known to the public, and is described in detail, for example, in the Journal of the Society of Electrophotography, Vol. 30, No. 3, pp. 312–322 "Method of Contact Charging." If desired, a uniform charging means comprising an ordinary corona discharger may be used instead of the contact charging means. The exposure means 20 selectively eliminates the charge on the surface of the image forming member 6 by light irradiation, thereby forming a latent electrostatic image on the surface of the image forming member 6. Such exposure means 20 may be constituted of a laser means which projects light onto the surface of the image forming member 6 according to an image signal from a computer or a word processor. Alternatively, the exposure means 20 may be constituted of an optical means which projects onto the surface of the image forming member 6 a reflected light from the document to be copied. In the developing zone 12, a developing device 26 constituted of, for example, a magnetic brush mechanism or the like, applies toner to a latent electrostatic image formed on the surface of the image forming member 6, thereby developing the latent electrostatic image to a toner image. In the illustrated embodiment, a toner charged to a positive polarity that is the same polarity as the polarity of the latent electrostatic image formed on the surface of the image forming member 6 is applied to uncharged regions of the latent electrostatic image formed on the surface of the image forming member 6, whereby the latent electrostatic image is developed (reversal development). In the transfer zone 14, the toner image on the surface of the image forming member 6 is transferred onto the surface of a transfer material 28 which is conveyed through the transfer zone 14. The transfer material 28 may be a sheet-like ordinary paper. The transfer of the toner image in the transfer zone 14 will be described later on in more detail. In the cleaning zone 16, the toner remaining on the surface of the image forming member 6 after transfer is removed from the surface of the image forming member 6 by a cleaning means 30. The cleaning means 30 may be of a well known type, including a cleaning blade to be contacted with the surface of the image forming member 6.

With reference to FIG. 2 along with FIG. 1, a transfer means 32 is disposed in conjunction with the transfer zone 14. The transfer means 32 includes a transfer material guide means 34 disposed upstream of the transfer zone 14. The transfer material guide means 34 in the illustrated embodiment comprises a lower guide means 38 defining the lower side of a transfer material conveying passage 36, and an upper guide means 40. The lower guide means 38 is composed of a support member 42, and a flexible plastic film (e.g. a polyethylene terephthalate film sold under the trade name "Lumilar") 44 disposed on the upper surface of the support member 42. The lower guide means 38 will be further explained later on. The upper guide means 40 may be formed of a suitable metal plate or the like. The transfer material 28, which may be a sheet-like ordinary paper, is fed one by one from a suitable feeding means (not shown) such as a cassette type feeding mechanism, and supplied to the nip between a pair of timing rollers 46 and The pair of timing rollers 46 and 48 are rotationally driven in the directions shown by an arrow 50 in synchronism with the rotation of the rotating drum 4, as required, to feed the transfer material 28 to the transfer zone 14 via the transfer material guide means 34.

The transfer means 32 also includes a charge supply member 52 disposed opposite to the image forming member 6 in the transfer zone 14. In the illustrated embodiment, a rotating shaft 54 is rotatably disposed below the rotating drum 4, and a roller constituting the charge supply member 52 is fixed to the rotating shaft 54. The central axis 56 of the rotating shaft 54 extends substantially parallel to, and below, the central axis 2 of the rotating drum 4 (hence, perpendicularly to the sheet surface in FIG. 1), and the charge supply member 52 is rotatable about the central axis 56. As shown in FIG. 1, it is advantageous that the roller constituting the charge supply member 52 is disposed opposite to the peripheral surface of the rotating drum 4 in an angular region which is below the central axis 2 of the rotating drum 4 and in which the peripheral surface of the rotating drum 4 gradually lowers as the rotating drum 4 rotates in the direction shown by arrow 8, i.e. the range $\alpha$ with an angle of 90 degrees positioned in the lower right quadrant in FIG. 1, especially in the region $\beta$ with an angle of approximate 30 degrees in a direction opposite to the direction of rotation of the rotating drum 4 as viewed from the lowermost portion of the rotating drum 4. It is essential that the distance D between the image forming member 6 and the roller constituting the charge supply member 52 should be set to be larger than the thickness T of the transfer material 28, and it is preferably about 0.2 to 2 mm. As clearly shown in FIG. 1, it is important that the transfer material 28, which is conveyed through the transfer material conveying passage 36 defined by the transfer material guide means 34 and the transfer zone 14, should have its surface brought into a sufficiently reliable contact with the surface of the image forming member 6, but should not be contacted with the charge supply member 52 in the transfer zone 14 (how to fulfill such requirements will be mentioned later on). The rotating shaft 54 is preferably rotationally driven at a desired speed in a direction shown by an arrow 58. The peripheral speed of the charge supply member (roller) 52 may be substantially the same as the peripheral speed of the image forming member 6 disposed on the rotating drum 4. In a normal condition, the transfer material 28 is passed through the transfer zone 14 while being guided so as not to contact the charge supply member 52. Because of a considerable curl of the transfer material 28 or any other cause, the front end portion of the transfer material 28 may contact the charge supply member 52 accidentally. Even in this case, when the roller constituting the charge supply member 52 is rotationally driven in the direction of conveyance of the transfer material 28, the transfer material 28 can be conveyed without causing a jam. By rotationally driving the roller constituting the charge supply member 52, it is also possible to prevent the surface of the charge supply member 52 from being contaminated locally by the toner. The roller constituting the charge supply member 52 is advantageously formed of a conductive synthetic rubber with a volume resistivity of about $10^5$ to $10^8$ Ω-cm. The charge supply member 52 is connected to a voltage application means 60. The voltage application means 60 applies to the charge supply member 52 a voltage of an opposite polarity (a negative polarity in the drawing) to the polarity (a positive polarity in the drawing) of the latent electrostatic image formed on the surface of the image forming member 6. The absolute value of the voltage applied to the charge supply member 52 may be about 2,000 to 3,000 V. If desired, the charge supply member 52 may be constituted of a conductive endless belt to be rotationally driven in a direction shown by arrow 58, or a stationary conductive member having a smooth surface, instead of the roller to be driven rotationally.

When the transfer material 28 is conveyed through the transfer zone 14, a weak corona discharge current, preferably, of about 0.5 to 10 μA is applied to the back of the transfer material 28 from the charge supply member 52. By the action of such a weak corona discharge current, the toner image formed on the surface of the image forming member 6 is transferred to the surface of the transfer material 28. A mere contact of the surface of the image forming member 6 with the surface of the transfer material 28 in the transfer zone 14 as required is sufficient to transfer the toner image from the surface of the image forming member 6 to the surface of the transfer material 28 fully satisfactorily. The distance D between the surface of the image forming member 6 and the surface of the charge supply member 52 is set to be larger than the thickness T of the transfer material 28. Accordingly, the surface of the transfer material 28 is not pressed, with an excessive force, against the surface of the image forming member 6. Hence, the so-called central missing phenomenon or the generation of image dust can be reliably prevented in the toner image transferred to the surface of the transfer material. In a normal state, the back of the transfer material 28 is not contacted with the surface of the charge supply member 52, and therefore, even if the surface of the charge supply member 52 is contaminated with the toner or the like, the back of the transfer material 28 is free from contamination. The corona discharge current to be applied to the back of the transfer material 28 from the charge supply member 52 is much smaller than the corona discharge current produced by an ordinary transfer corona discharger, so that the generation of ozone, if any, is negligible.

Further with reference to FIGS. 1 and 2, a transfer material receiving means 62 is disposed downstream of the transfer zone 14 as viewed in the direction of conveyance of the transfer material. The upper surface of the transfer material receiving means 62 is defined by an upstream member 64 which extends substantially horizontally, and a succeeding main member 66 which extends somewhat downwardly inclinedly toward the downstream side and then extends substantially horizontally. The upstream member 64 is formed of a transparent or translucent material which permits passage of light. Below this upstream member 64 is disposed a lamp 68 constituting a charge eliminating means. On the upper surface of the main member 66 are formed a plurality of guide protrusions 70 spaced in the width direction as illustrated in FIG. 2. Downstream of the transfer material receiving means 62 is disposed a guide member 72, and further downstream of the same are disposed a pair of rollers 74 and 76 constituting a fixing means. The transfer material 28 having the toner image transferred thereto in the transfer zone 14 is separated from the surface of the image forming member 6, advanced onto the surface of the transfer material receiving means 62, and further conveyed under its guidance. Light from the lamp 68 disposed below the upstream member 64 in the transfer material receiving means 62 penetrates through the upstream member 64 and the transfer material 28 passing above it, and irradiates the image forming member 6 disposed on the peripheral surface of the rotating drum 4, thereby eliminating charge from the image forming member 6 downstream of the transfer zone The transfer material 28 is conveyed under guidance by the upper surface of the transfer material receiving means 62 and the upper surface of the guide member 72, and guided to the pair of rollers 74 and 76. At least one of the rollers 74 and 76 is equipped with a heating means (not shown), which heats and fixes the toner image on the transfer material 28 during the passage of the transfer material 28 between the rollers 74 and 76.

In the image-forming machine constructed in accordance with the present invention, it is important, as described above, that the surface of the transfer material 28 to be conveyed through the transfer zone 14 be brought into a fully satisfactory contact with the surface of the image forming member 6, and that the transfer material 28 be prevented from contacting the roller constituting the charge supply member 52. To fulfill these requirements fully stably, the following unique construction is adopted in the illustrated embodiment: With reference to FIG. 1, a further description will be offered, assuming that the common tangent line CL contacts the peripheral surface of the rotating drum 4 and then contacts the charge supply member 52, as viewed in the direction of rotation of the rotating drum 4. At least the front end portion of the lower guide means 38 of the transfer material guide means 34 extends toward the peripheral surface of the rotating drum 4 in the aforementioned angular region $\alpha$ (i.e. an angular region which is below the central axis 2 of the rotating drum 4 and in which the peripheral surface of the rotating drum 4 gradually lowers as the rotating drum 4 rotates in the direction shown by arrow 8), and extends below the tangent line CL at the following angle $\theta$ to it: 0 degrees$\leqq\theta\leqq$90 degrees, preferably 30 degrees$\leqq\theta$60 degrees. With the underside of the transfer material 28 being guided by the lower guide means 38 of such a shape, the transfer material 28 is conveyed into the transfer zone 14. Consequently, the surface of the transfer material 28 is contacted fully satisfactorily with the surface of the image forming member 6, even if the stiffness of the transfer material 28 slightly varies. In the case where the angle $\theta$ is smaller than 0 degree, the pressure of contact of the surface of the transfer material 28 with the surface of the image forming member 6 tends to become markedly low, and the back of the transfer member 28 tends to contact the charge supply member 52. In the case where the angle $\theta$ is larger than 90 degrees, the transfer material 28 conveyed toward the peripheral surface of the rotating drum 4 can not be smoothly moved along the peripheral surface of the rotating drum 4, but remains stuck to the peripheral surface of the rotating drum 4. Thus, its movement may be hampered, and the transfer material 28 may remain jammed there.

Furthermore, the lower guide means 38 of the transfer material guide means 34 includes, as described above, the flexible plastic film 44 which is disposed on the upper surface of the support member 42 and made to protrude downstream. The front end portion of the lower guide means 38 is defined by the protruding portion of the plastic film 44. The plastic film 44 which, for example, may be a polyethylene terephthalate film commercially available under the trade name "Lumilar" preferably has a protruding length, FL, of about 2 to 4 mm, and a thickness, FT, of about 0.15 to 0.25 mm. If the front end portion of the lower guide means 38 is defined by a rigid material such as a metal plate, a relatively high resistance is imposed by the front end portion of the lower guide means 38 to the transfer material 28, when the rear edge of the transfer material 28 leaves the pair of timing rollers 46 and 48 (accordingly, when the delivery force imparted by the pair of timing rollers 46 and 48 to the transfer material 28 vanishes). Owing to this resistance, the forward movement of the transfer material 28 is instantaneously stopped or reduced, whereby a transfer displacement (transfer distortion) of the toner image is liable to occur in the rear end portion of the transfer material 28. According to our experience, if the front end portion of the lower guide means 38 is defined by the protruding portion of the flexible plastic film 44, as in the illustrated embodiment, the resistance given by the lower guide means 38 to the transfer material 28 is reduced, thus making it possible to prevent the transfer distortion of the toner image fully reliably.

With further reference to FIG. 1, in the illustrated embodiment, the upper surface of the transfer material receiving means 62 intersects the common tangent line CL at a site apart by the distance L1 along the line CL from the site of contact of the line CL with the peripheral surface of the rotating drum 4. Downstream of the site apart by the L1 from that site of contact, the upper surface of the transfer material receiving means 62 is positioned above the line CL. As long as the smooth conveyance of the transfer material 28 is not hampered, the distance L1 should desirably be short, and is advantageously set as $L1 \leqq 50$ mm. If the upper surface of the transfer material receiving means 62 which guides the transfer material 28 to be conveyed further downstream of the transfer zone 14 is positioned above the line CL downstream of the region L1 ($L1 \leqq 50$ mm), the transfer material 28 conveyed downstream of the transfer zone 14 is biased upwards upon support by the upper surface of the transfer material receiving means 62. As a result, the first half of the transfer material 28 (i.e. the portion that passed the transfer zone 14) is prevented from sagging downwards due to its weight, etc. Hence, a good contact between the surface of the transfer material 28 and the image forming member 6 in the transfer zone 14 continues to be maintained, and the back of the transfer material 28 is reliably prevented from contacting the surface of the charge supply member 52.

Figure 3:
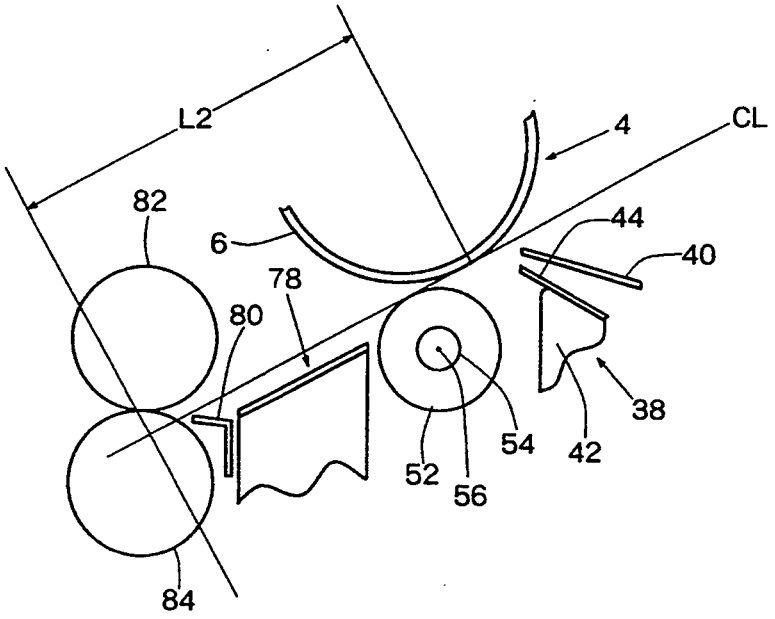
FIG. 3 is a sectional view showing, in a simplified manner, a part of a modified example of an image-forming machine constructed in accordance with the present invention.

FIG. 3 shows a modified example of the construction downstream of the transfer zone 14. In this modified example, the dimensions of a transfer material receiving means 78 and a guide member 80 in the direction of conveyance of the transfer material are considerably small, and the nip between a pair of rollers 82 and 84 constituting fixing means is located at the distance L2 along the line CL from the site of contact of the CL with the peripheral surface of the rotating drum 4. The distance L2 is set to satisfy $L2 \leqq 50$ mm. In this case, it is permissible to position the nip between the pair of rollers 82 and 84 above the line CL, instead of positioning the upper surface of the transfer material receiving means 78 or the guide member 80 above the line CL. When the front end portion of the transfer material 28 conveyed from the transfer zone 14 is nipped between the pair of rollers 82 and 84, the first half of the transfer material 28 (i.e. the portion that passed the transfer zone 14) is prevented from sagging downwards due to its weight, etc. Hence, a good contact between the surface of the transfer material 28 and the surface of the image forming member 6 in the transfer zone 14 continues to be maintained, and the back of the transfer material 28 is reliably prevented from contacting the surface of the charge supply member 52.

Figure 4:
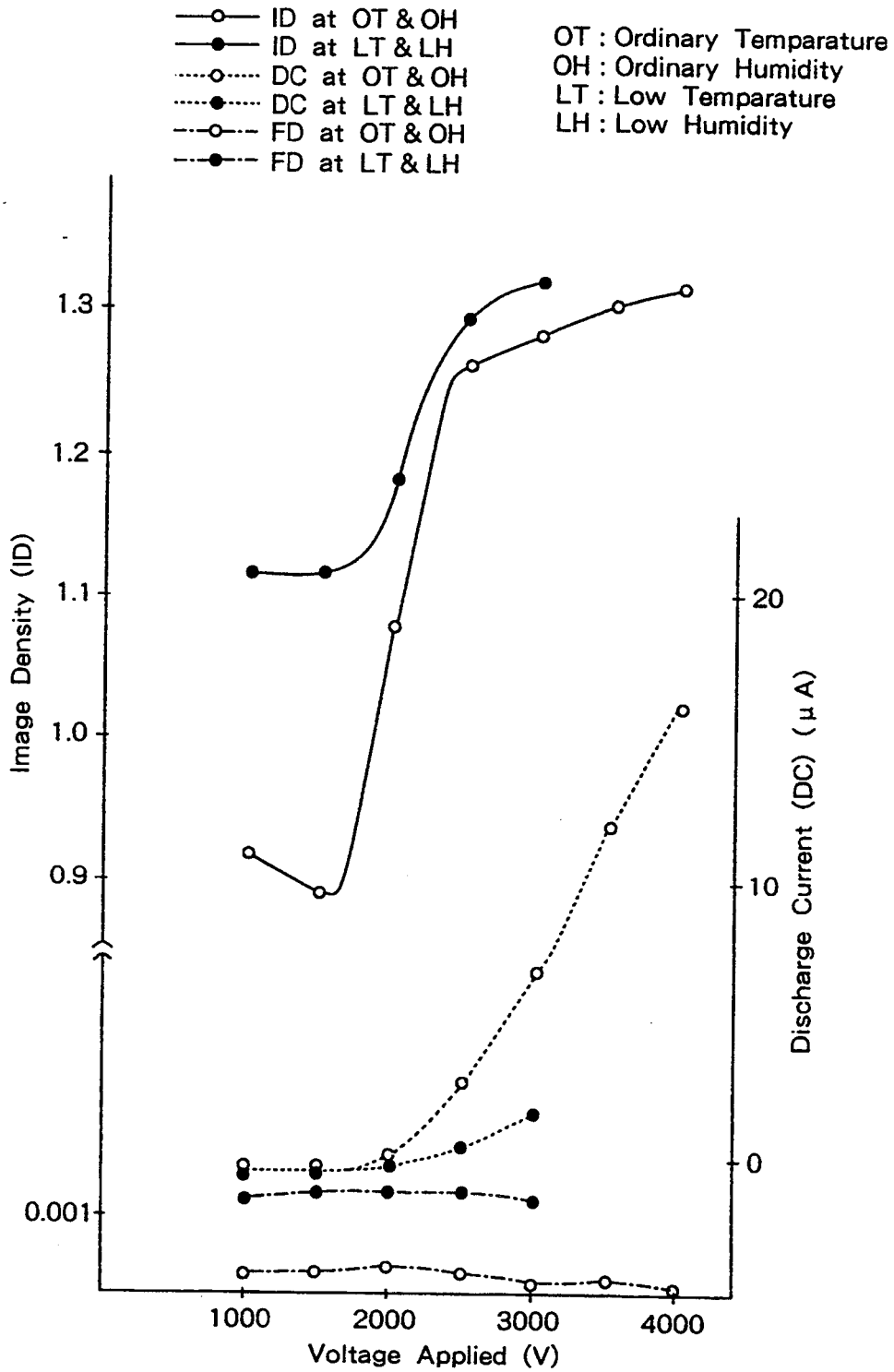
FIG. 4 is a graph showing the results of measurement in an experiment on the transfer of a toner image.

Next, an experimental example of toner image transfer by a transfer means improved in accordance with the present invention will be described below. In an image-forming machine of the type illustrated in FIGS. 1 and 2, while a voltage to be applied to the charge supply member 52 by the voltage application means 60 was being varied, a toner image formed on the surface of the image forming member 6 was transferred to the surface of the transfer material 28. The image forming member 6 disposed on the surface of the rotating drum 4 was the organic semiconductor disclosed in the specification of Japanese Patent Application No. 61436/1991 filed by the present applicant, and its outer diameter was 30 mm. The charge supply member 52 was formed of conductive rubber with a volume resistivity of $5.7 \times 10^7$ Ω-cm, and its outer diameter was 14 mm. The distance D between the surface of the image forming member 6 and the charge supply member 52 was 0.5 mm. The transfer material 28 was a 0.10 mm thick Neusiedler (trade name) paper widely used in European countries. The surface of the image forming member 6 was uniformly charged to +700 V, and then laser light was selectively irradiated to form a latent electrostatic image on the surface of the image forming member 6, followed by developing the latent electrostatic image to a toner image. The exposure means used for laser irradiation and the developing device used for development were substantially the same as those used in a laser printer sold by Mita Industrial Co., Ltd. under the trade name "LP-X2." Transfer experiments were conducted in two states, i.e. ordinary temperature and ordinary humidity (temperature of 21° C., humidity of 49%), and low temperature and low humidity (temperature of 10° C., humidity of 15%). After transfer, the image density of the image areas, ID, and the image density of the non-image areas (fog density), FD, on the surface of the transfer material 28 were measured by a reflection densitometer. Moreover, the corona discharge current applied from the charge supply member 52 to the back of the transfer material 28 was measured. The results are shown in FIG. 4. In an ordinary printer or copying machine, a sufficient image density of the image areas (ID) is 1.2 or more, while a sufficient image density of the non-image areas (FD) is 0.005 or less. Therefore, it is understood that when the absolute value of the voltage applied is about 2,000 to 3,000 V, satisfactory results can be obtained.

Preferred embodiments of an image-forming machine constructed in accordance with the present invention have been described in detail with reference to the appended drawings. It should be understood that the present invention is not limited to such embodiments, but various changes and modifications may be made without departing from the scope of the present invention.

What we claim is:

1. An image-forming machine comprising:

an image forming member movable through a passage having, in a downstream direction, a latent electrostatic image forming zone, a developing zone, and a transfer zone, latent electrostatic image forming means for forming a latent electrostatic image on a surface of the image forming member in the latent electrostatic image forming zone, developing means for developing a latent electrostatic image on the surface of the image forming member to a toner image in the developing zone, transfer material conveying means for conveying a transfer material through the transfer zone, and toner image transfer means for transferring a toner image on the surface of the image forming member onto a surface of transfer material in the transfer zone;

the toner image transfer means including a conductive charge supply member disposed in opposition to the image forming member, voltage application means for applying a voltage to the charge supply member to cause the charge supply member to apply a discharge current in a range from 0.5 to 10 μA to transfer material in the transfer zone, and transfer material guide means for guiding transfer material being conveyed through the transfer zone such that a surface of transfer material in the transfer zone is brought into contact with the surface of the image forming member to transfer a toner image on the surface of the image forming member onto such surface of transfer material in the transfer zone;

the charge supply member being disposed in opposition to the image forming member at a distance from the image forming member that is greater than the thickness of transfer material conveyed through the transfer zone, and the transfer material guide means guiding transfer material so that it is conveyed through the transfer zone without coming into contact with the charge supply member.

2. The image-forming machine of claim 1 wherein the distance between the charge supply member and the image forming member is 0.2 to 2.0 mm.

3. The image-forming machine of claim 1 wherein the machine applies a toner charged with the same polarity as the polarity of the charge of a latent electrostatic image formed on the surface of the image forming member to the surface of the image forming member to develop such latent electrostatic image to a toner image, and wherein the voltage application means applies, to the charge supply member, a voltage that is of an opposite polarity to the polarity of the charge of such latent electrostatic image formed on the surface of the image forming member, and the absolute value of the voltage is 2,000 to 3,000 V.

4. The image-forming machine of claim 1 wherein the machine applies a toner charged with the same polarity as the polarity of the charge of a latent electrostatic image formed on the surface of the image forming member to the surface of the image forming member to develop such latent electrostatic image to a toner image, and wherein the voltage application means applies, to the charge supply member, a voltage that is of an opposite polarity to the polarity of the charge of such latent electrostatic image formed on the surface of the image forming member.

5. The image forming machine of claim 1 wherein the charge supply member is constructed of a roller that is rotationally driven in the direction of conveyance of transfer material.

6. An image-forming machine comprising:

an image forming member movable through a passage which includes, in a downstream direction, a latent electrostatic image forming zone, a developing zone, and a transfer zone, the image forming member being disposed on a peripheral surface of a rotatable drum which is rotationally driven in a predetermined direction about a central axis extending substantially horizontally;

latent electrostatic image forming means for forming a latent electrostatic image on a surface of the image forming member in the latent electrostatic image forming zone;

developing means for developing a latent electrostatic image on the surface of the image forming member to a toner image in the developing zone;

transfer material conveying means for conveying transfer material through the transfer zone; and toner image transfer means for transferring a toner image on the surface of the image forming member onto a surface of transfer material in the transfer zone, the toner image transfer means including a conductive charge supply member disposed in opposition to the image forming member, voltage application means for applying a voltage to the charge supply member, and transfer material guide means for guiding transfer material conveyed through the transfer zone, the charge supply member having a roller that is in opposition to the peripheral surface of the rotatable drum in an angular region which is below a central axis of the rotatable drum and in which the peripheral surface of the drum gradually lowers in accordance with the rotation of the drum, the charge supply member being rotationally driven, about the central axis thereof, in the direction of conveyance of transfer material, the central axis of the charge supply member extending substantially parallel to the central axis of the rotating drum;

wherein the surface of transfer material in the transfer zone is brought into contact with the surface of the image forming member to transfer a toner image on the surface of the image forming member onto the surface of such transfer material;

wherein the charge supply member is disposed in opposition to the image forming member and at a distance from the image formed member greater than the thickness of transfer material conveyed through the transfer zone;

wherein the transfer material guide means guides transfer material so as to be conveyed through the transfer zone without coming into contact with the charge supply member;

wherein the transfer material guide means includes lower guide means which defines an underside of a transfer material conveying passage upstream of the transfer zone; and a front end portion of the lower guide means extends toward the peripheral surface of the rotatable drum below a common tangent line, wherein the common tangent line contacts the peripheral surface of the drum and the peripheral surface of the roller, in such a manner as to form an angle of $\Theta$ degrees with respect to the common tangent line, wherein $0° \leqq \Theta \leqq 90°$.

7. The image-forming machine of claim 6 wherein said angle of $\theta$ degrees with respect to the common tangent line is $30° \leqq \theta 60°$.

8. The image-forming machine of claim 6 further including a transfer material receiving means having an upper surface that guides transfer material disposed downstream of the transfer zone, wherein the upper surface of transfer material receiving means intersects the common tangent line at a site outside a zone defined by a distance of 50 mm which extends from a site of contact of the common tangent line with the peripheral surface of the rotating drum.

9. The image-forming machine of claim 6 wherein the front end portion of the lower guide means in the transfer material guide means is formed of a flexible plastic film which is made to protrude in a downstream direction.

10. The image-forming machine of claim 9 wherein the plastic film has a thickness of 0.15 to 0.25 mm and a protruding length of 2 to 4 mm.

11. The image-forming machine of claim 6 wherein a pair of rollers which are rotationally driven in the direction of conveyance of transfer material are disposed downstream of the transfer zone, and a nip between the pair of rollers is positioned above the common tangent line at a distance less than or equal to 50 mm from the position of contact of the common tangent line with the peripheral surface of the rotatable drum, as viewed in the direction of conveyance of transfer material.

12. An image-forming machine comprising:

an image forming machine movable through a passage which includes, in a downstream direction, a latent electrostatic image forming zone, a developing zone, and a transfer zone, latent electrostatic image forming means for forming a latent electrostatic image on a surface of the image forming member in the latent electrostatic image forming zone, developing means for developing a latent electrostatic image on the surface of the image forming member to a toner image in the developing zone, transfer material conveying means for conveying transfer material through the transfer zone, and toner image transfer means for transferring a toner image on the surface of the image forming member onto a surface of the transfer material in the transfer zone;

said toner image transfer means including a conductive charge supply member disposed in opposition to the image forming member, voltage application means for applying a voltage to the charge supply member, and transfer material guide means for guiding transfer material being conveyed through the transfer zone, wherein the surface of the transfer material is brought into contact with the surface of the image forming member in the transfer zone to transfer a toner image on the surface of the image forming member onto the surface of conveyed transfer material, wherein the charge supply member is constructed of a roller that is disposed in opposition to the image forming member and at a distance from the image forming member greater than the thickness of the transfer material, and wherein the transfer material guide means guides transfer material so as to be conveyed through the transfer zone without coming into contact with the roller.

* * * * *